United States Patent [19]

Teraura

[11] Patent Number: 4,495,881

[45] Date of Patent: Jan. 29, 1985

[54] BOAT STEERING MECHANISM

[75] Inventor: Makoto Teraura, Takarazuka, Japan

[73] Assignee: Nippon Cable System Inc., Takarazuka, Japan

[21] Appl. No.: 495,112

[22] Filed: May 16, 1983

[30] Foreign Application Priority Data

Jul. 5, 1982 [JP] Japan ..... 57-117089

[51] Int. Cl.[3] ..... B63H 25/10

[52] U.S. Cl. ..... 114/159; 114/144 R; 440/60; 440/62; 74/480 B; 74/484 R; 74/498; 74/501 R; 180/145

[58] Field of Search ..... 440/62, 60, 53, 58; 114/144 R, 159, 156; 74/498, 480 B, 484 R, 501 R; 180/145, 147; 244/233

[56] References Cited

U.S. PATENT DOCUMENTS

| | | | |
|---|---|---|---|
| 2,601,791 | 7/1952 | Morse | 114/144 R |
| 2,767,596 | 10/1956 | Simon et al. | 74/480 B |
| 3,063,303 | 11/1962 | Cadwallader | 74/480 B |
| 3,208,300 | 9/1965 | Morse | 114/144 R |

FOREIGN PATENT DOCUMENTS

| | | | |
|---|---|---|---|
| 697035 | 11/1964 | Canada | 440/62 |

*Primary Examiner*—Trygve M. Blix
*Assistant Examiner*—Patrick W. Young
*Attorney, Agent, or Firm*—Armstrong, Nikaido Marmelstein & Kubovcik

[57] ABSTRACT

A boat steering mechanism for permitting a remotely mounted rudder control by means of a push-pull control cable, comprising a rack engaging with a pinion and being formed with a groove for inserting an inner cable, a projection projecting from the center or its vicinity of a rack casing into which the rack is slidably inserted, an inclined hole for slidably inserting the inner cable, perforated through the projection into the groove and a fitting member for fastening one end of the inner cable, to the rack at one end of the groove, whereby the push-pull control cable can be provided with a large curvature and the sliding resistance of the whole mechanism can be decreased.

3 Claims, 10 Drawing Figures

BOAT STEERING MECHANISM

BACKGROUND OF THE INVENTION

The present invention relates to a novel boat steering mechanism, and more particularly to a boat steering mechanism in which a push-pull control cable is led out of the center or its vicinity, in the longitudinal direction, of a rack and cable assembly, whereby the push-pull control cable can be provided with a large curvature, and which has a simple structure.

Hitherto, there is on the market a boat steering mechanism which can control a remotely mounted rudder by means of a push-pull control cable, which is suggested by U.S. Pat. No. 3,208,300. As shown in FIGS. 6 to 8, the steering mechanism comprises a pinion 22 secured to a steering wheel shaft 21, a rack 23 the teeth of which mesh with teeth of the pinion 22, an inner cable 24 of the push-pull control cable which is connected to one end of the rack 23 and a rack cartridge 25 for slidably guiding and receiving the rack 23. The steering mechanism translates the rotative motion of a steering wheel 26 into the linear motion of the inner cable 24 of the push-pull control cable by means of the pinion 22 and the rack 23, whereby the steering mechanism can control a remotely mounted rudder.

In the above-mentioned boat steering mechanism, the inner cable 24 is slidably pushed and pulled in an outer casing 27 by the application of either tensile or compressive forces. The inner cable 24 must be guided so as to not bend in the rack cartridge 25 by the compressive force. Therefore, as shown in FIG. 8, it requires that a rod 28, which does not need a guide member even in the application of compressive forces, is connected to one end of the inner cable 24. Also, it requires that a guide pipe 29 for guiding the inner cable 24 extended from the outer casing 27 is extended from the inside of the outer casing 27 of the rack cartridge 25. The boat steering mechanism of the above-mentioned construction has a disadvantage that a complicated construction is necessitated because of requiring the rod 28 and the guide pipe 29, and because of the telescoping arrangement of the rod 28, the guide pipe 29 and the rack 23. Also, the boat steering mechanism has another disadvantage that large resistance is generated between the rack 23 and the guide pipe 29 and between the rod 28 and the guide pipe 29 due to sliding friction. Also, the boat steering mechanism has the other disadvantage that since a member 30 for fixing the outer casing 27 of the control cable is fastened to one end of the rack cartridge 25, the length of the rack cartridge 25 becomes longer in a longitudinal direction. When using the boat steering mechanism in the narrow space of a boat, the curvature of the curved portion in the push-pull control cable has a small radius as shown in FIG. 6. Therefore, the boat steering mechanism has the further disadvantage that the sliding resistance of the inner cable becomes larger.

OBJECT OF THE INVENTION

An object of the present invention is to provide a boat steering mechanism in which a push-pull control cable is led out of the center or its vicinity, in the longitudinal direction, of a rack and cable assembly, whereby the push-pull control cable can be provided with a large curvature.

Another object of the invention is to provide a boat steering mechanism which has a small sliding resistance of an inner cable and has a high transfer efficiency of operating force.

Another object of the invention is to provide a boat steering mechanism which is constructionally uncomplicated and inexpensive to manufacture.

Other objects and advantages of the invention will become apparent from the following description with reference to the accompanying drawings.

DETAILED EXPLANATION OF THE INVENTION

Figure 1:
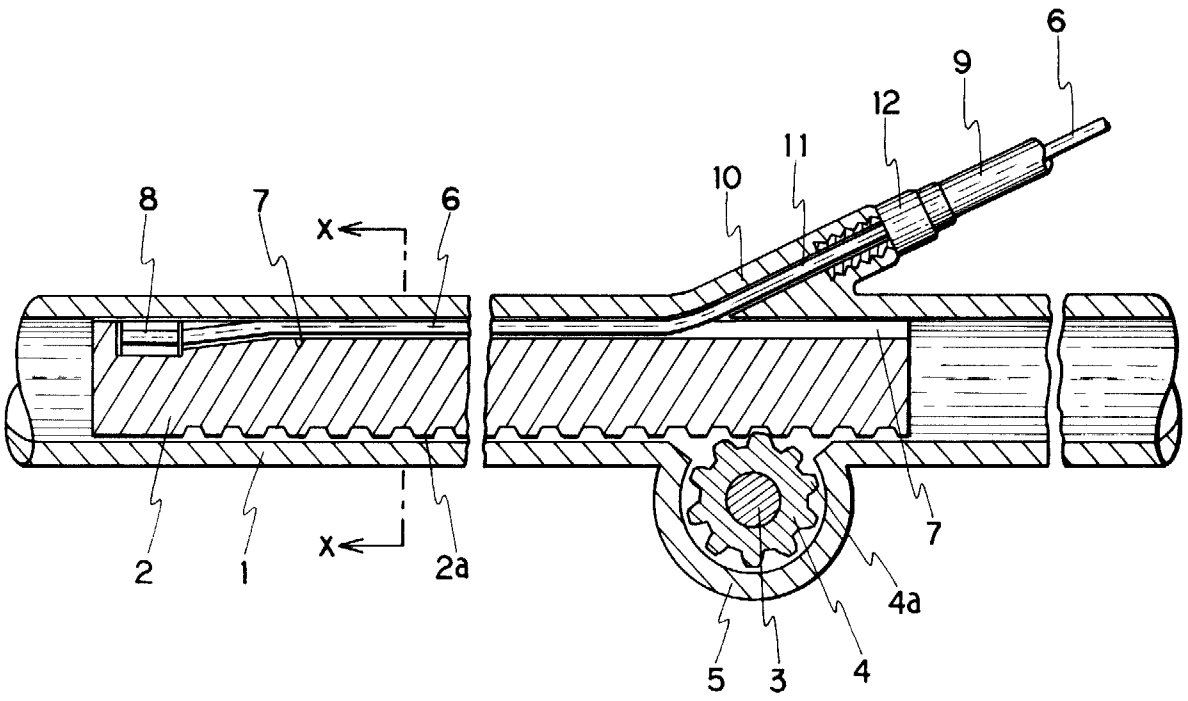
FIG. 1 is a longitudinal sectional view for showing an embodiment of an improved boat steering mechanism of the present invention.
Figure 2A:
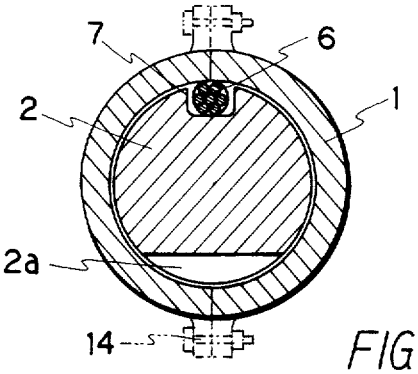
FIG. 2*a* is a sectional view taken along line X—X of FIG. 1.

In FIGS. 1 to 2*a*, a rack 2 is slidably inserted into a rack casing 1. The linear rack 2 is provided with a series of teeth 2*a* in a longitudinal direction thereof. A pinion 4 is securely attached to a steering shaft 3. Teeth 4*a* of the pinion 4 are engaged and meshed with the teeth 2*a* of the rack 2. The pinion 4 is disposed in a pinion casing 5 which is formed with the rack casing 1 as one body. The rack 2 is formed with a groove 7 for inserting an inner cable 6 of a control cable on the side opposite to the teeth 2*a* of rack 2. A fitting member 8 for fastening one end of the inner cable 6 of the control cable is secured to the rack 2 at one end of the groove 7. A projection 10 for fastening one end of an outer casing 9 of the control cable is projected from the center or its vicinity of the rack casing 1 with a slight gradient as to a longitudinal direction of the rack casing 1. The projection 10 has an inclined hole 11 for slidably inserting the inner cable 6. A tension adjusting member 12 for adjusting the length of the outer casing 9 is screwed on the top end of the projection 10. One end of the outer casing 9 is connected with the projection 10 by means of the tension adjusting member 12. The other end of the outer casing 9 is connected with a control unit of a rudder. The inner cable 6 is slidably pushed and pulled in the outer casing 9.

In a boat steering mechanism of the invention, since the rack 2, the pinion 4, the inner cable 6 and the fitting member 8 are provided in the rack casing 1, it is disired to provide a flange 14 shown in an imaginary line of FIG. 2*a* in the rack casing 1 in order to easily assemble the boat steering mechanism.

Figure 2B:
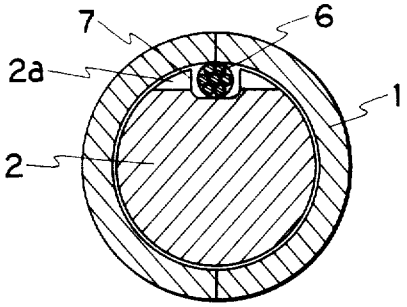
FIGS. 2*b* to 2*c* are respectively a sectional view for showing another embodiment of the boat steering mechanism of the invention.

In the case of the above-mentioned embodiment, the projection 10 of the rack casing 1 and the groove 7 of the rack 2 are provided on the side opposite to the teeth 2a of the rack 2 and the teeth 4a of the pinion 4, i.e. on the top side of FIG. 1 and FIG. 2a. However, the arrangement of the projection 10 and the groove 7 is not necessarily limited. For example, as shown in FIG. 2b, the groove 7 of the rack 2 may be provided in the teeth 2a of the rack 2 and the projection 10 of the rack casing 1 may be provided on the side of the teeth 2a so as to correspond to the groove 7. The arrangement of the projection 10 and the groove 7 can be optionally selected depending on the condition of fitting a steering wheel mechanism to a dashboard 15 shown in FIG. 5.

Figure 3:
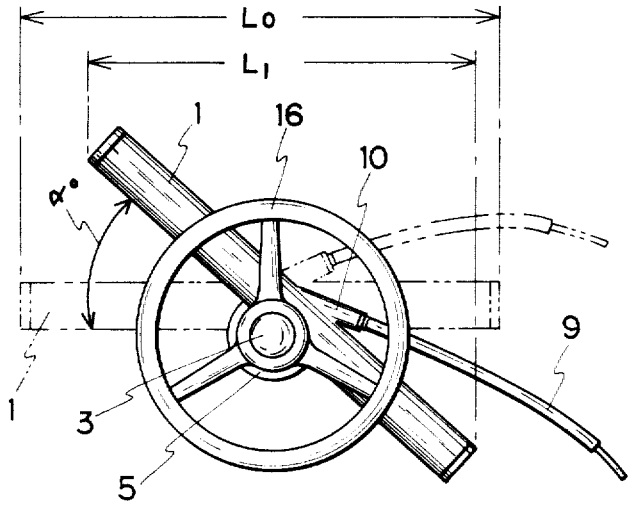
FIG. 3 is a schematic front view of the boat steering mechanism as seen from a steering wheel.

Further, in a boat steering mechanism of the invention, the rack casing 1 can be provided at an optional direction around the steering shaft 3. As shown in FIG. 3, when the boat steering mechanism is seen from the operating side (the side of a steering wheel (16)), it is desirable to provide the rack casing 1 at a prescribed rotational angle $\alpha°$ (preferably 30° to 45°) to a horizontal direction around the steering shaft 3. Thereby, the width $L_1$ of the steering wheel mechanism becomes narrower than the width $L_0$ of the steering wheel mechanism (shown by imaginary line in FIG. 3) which is provided in a horizontal direction. Accordingly, the boat steering mechanism of the invention can be more compactly arranged and can be suitably used even in a narrow space of the back side of the dashboard 15.

Hereinafter, the functions and advantages of a boat steering mechanism of the invention will be explained.

Figure 4:
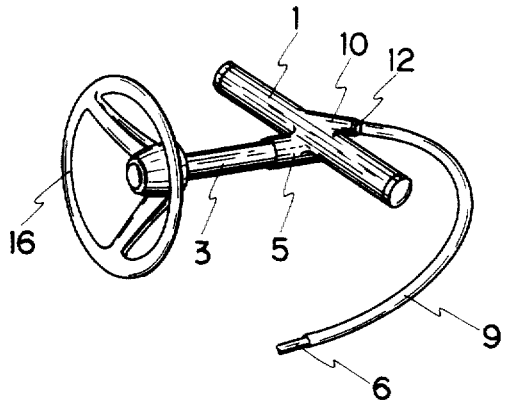
FIG. 4 is a perspective view of the boat steering mechanism of FIG. 1.
Figure 5:
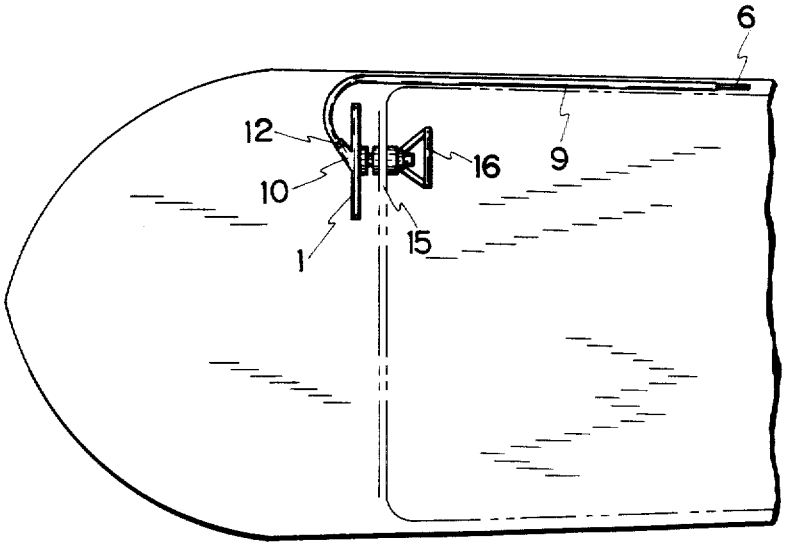
FIG. 5 is a schematic plan view of a boat employing the boat steering mechanism of FIG. 4.
Figure 6:
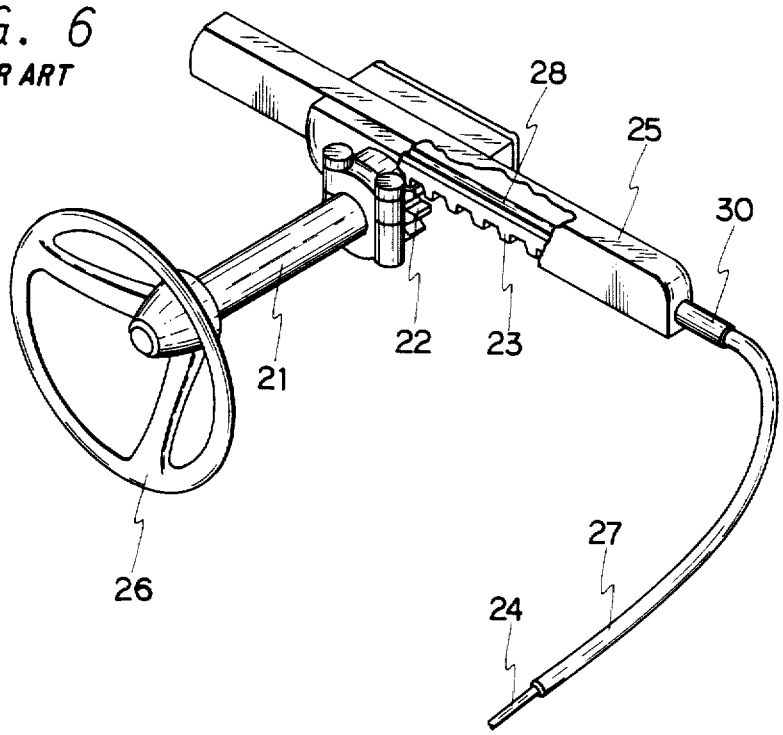
FIG. 6 PRIOR ART
FIG. 6 is a partially cutaway perspective view of a conventional boat steering mechanism.
Figure 7:
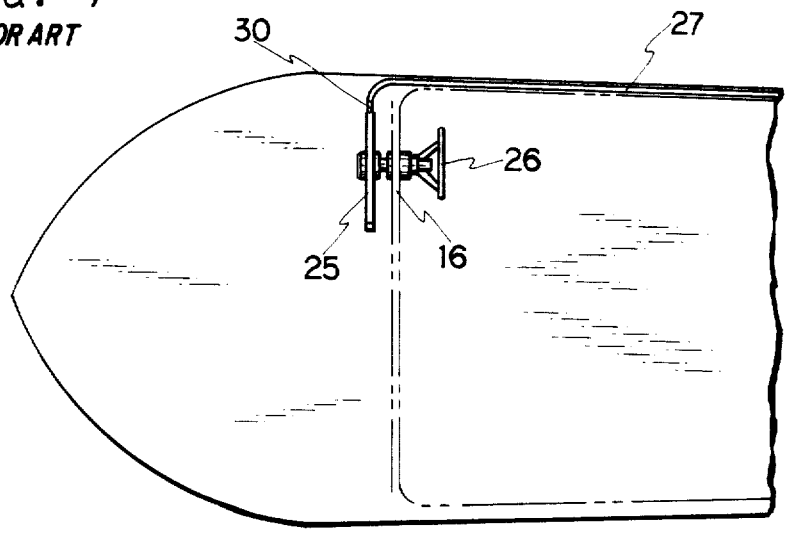
FIG. 7 PRIOR ART
FIG. 7 is a schematic plan view of a boat employing the conventional boat steering mechanism of FIG. 6.

In FIGS. 4 to 5, when a steering wheel 16 which is fitted to the steering shaft 3 is turned in either direction, the rack 2 slides in the rack casing 1 in a longitudinal direction thereof by means of the pinion 4. At that time, the inner cable 6 one end of which is secured to the rack 2 is pushed from the groove 7 toward a control unit of a rudder or the inner cable 6 is pulled into the groove 7 through the inclined plane 13a and the inclined hole 11, whereby the rudder can be operated or controlled.

In the boat steering mechanism of the invention, as shown in FIGS. 4 to 5, since the push-pull control cable is led out of the center or its vicinity of a rack and cable assembly, the longitudinal length of the rack casing 1 can be shortened. The words "rack and cable assembly" means a mechanism comprising the rack casing 1, the rack 2, the pinion 4 and one end portion of the inner cable 6. Furthermore, since the push-pull control cable is provided with a large curvature, the inner cable 6 is smoothly, efficiently pushed and pulled in the outer casing 9.

Figure 8:
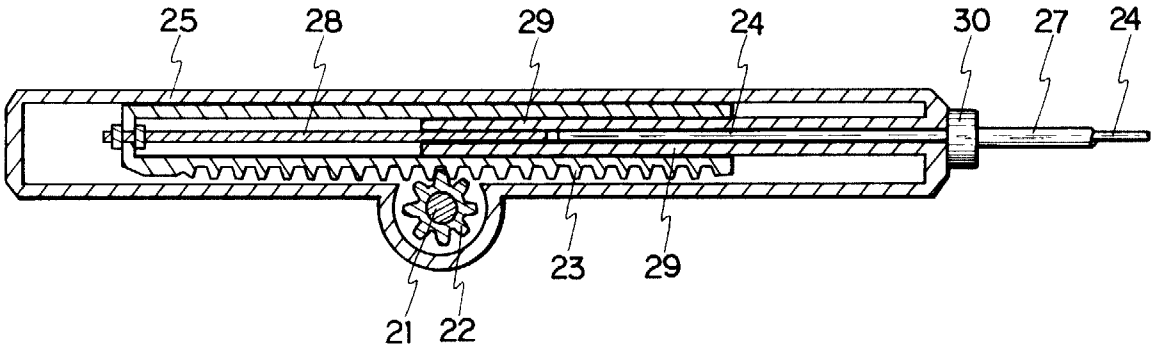
FIG. 8 PRIOR ART
FIG. 8 is a longitudinal sectional view for showing the boat steering mechanism of FIG. 6.

Also, in the boat steering mechanism of the invention, since the inner cable 6 extended from the outer casing 9 is guided through the inclined hole 11 and the inclined plane 13a by a cylindrical space which is composed of the groove 7 and an inner wall of the rack casing 1, one end of the inner cable 6 can be directly secured to the rack 2. The rod 28 and the guide pipe 29, which the conventional boat steering mechanism needs as shown in FIG. 8, are not required. Furthermore, since the rod 28 and the guide pipe 29 are not required, the boat steering mechanism of the invention is constructionally uncomplicated and inexpensive to manufacture. In the boat steering mechanism, there is only the linear contact of the top portion of the inner cable 6 and the inner wall of the rack casing 1 with the exception of the slidable contact of the rack 2 and the inner wall of the rack casing 1. Accordingly, since the boat steering mechanism of the invention has little abrasion of the inner cable 6 depending upon the use thereof and has a small sliding resistance of the inner cable 6, the boat steering mechanism of the invention has an advantage of having a high transfer efficiency of the operating force.

Figure 2C:
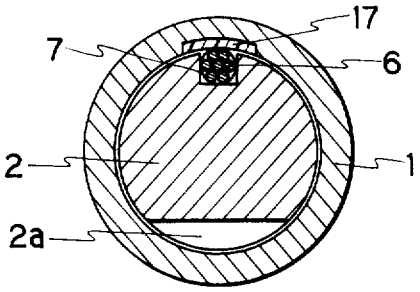

In the boat steering mechanism of the present invention, for decreasing a sliding resistance, it is desirable to provide a resinous slider 17 as shown in FIG. 2c to the portion of the rack casing 1 which is in contact with the inner cable 6.

What we claim is:

1. A boat steering mechanism for controlling a remotely mounted rudder by means of a push-pull control cable having an outer casing and an inner cable which is slidably pushed and pulled in said outer casing, comprising (a) a pinion attached to a steering shaft;

(b) A linear rack having teeth meshing with teeth of said pinion and being formed with a longitudinal groove for receiving said inner cable;

(c) a rack casing into which said linear rack is slidably inserted;

(d) a projection projecting from the center or its vicinity of said rack casing, and a member on the top end of said projection for fastening one end of said outer casing to said rack casing;

(e) an inclined hole for slidably inserting said inner cable, extending from the top end of said projection to said groove; and (f) a fitting member for fastening one end of said inner cable to said rack at one end of said groove; said rack casing being mounted to the boat at a prescribed rotational angle to a horizontal direction around the steering shaft.

2. The boat steering mechanism of claim 1, wherein said member for fastening one end of said outer casing is a tension adjusting member for adjusting a length of said outer casing.

3. The boat steering mechanism of claim 1, wherein said rack casing is provided with a resinous slider on the portion which comes in slidable contact with said inner cable.

* * * * *